US008292422B2

(12) United States Patent
Yamamoto

(10) Patent No.: US 8,292,422 B2
(45) Date of Patent: Oct. 23, 2012

(54) IMAGE RECORDING APPARATUS

(75) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 494 days.

(21) Appl. No.: 12/507,789

(22) Filed: Jul. 22, 2009

(65) Prior Publication Data

US 2010/0020152 A1 Jan. 28, 2010

(30) Foreign Application Priority Data

Jul. 22, 2008 (JP) ..... 2008-188765

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS

2005/0056992 A1* 3/2005 Ono ..... 271/272

FOREIGN PATENT DOCUMENTS

| | | | |
|---|---|---|---|
| JP | H03-090378 | A | 4/1991 |
| JP | H05-068991 | U | 9/1993 |
| JP | H10-279130 | A | 10/1998 |
| JP | H11-115274 | A | 4/1999 |
| JP | 2006-021919 | A | 1/2006 |
| JP | 2007-168277 | A | 7/2007 |
| JP | 2007-188440 | A | 7/2007 |

OTHER PUBLICATIONS

Japan Patent Office; Notification of Reason for Refusal in Japanese Patent Application No. 2008-188765 (counterpart to the above-captioned U.S. patent application) mailed May 6, 2010.

* cited by examiner

*Primary Examiner* — Stephen Meier
*Assistant Examiner* — Tracey McMillon
(74) *Attorney, Agent, or Firm* — Baker Botts L.L.P.

(57) ABSTRACT

An image recording apparatus including: (a) a conveying device for conveying a recording medium on a supporting surface; (b) a nip roller movable to be brought into contact with the conveyed recording medium when the conveyed recording medium has a portion positioned in a contactable position; (c) a moving device for moving the nip roller, so as to place the nip roller selectively in a gripping state and a releasing state, such that the nip roller, while being placed in the gripping state, is held in contact with the conveyed recording medium so as to cooperate with the supporting surface to grip the conveyed recording medium therebetween when the conveyed recording medium has a portion positioned in the contactable position, and such that the nip roller, while being placed in the releasing state, is not in contact with the conveyed recording medium; and (d) a controlling device for controlling the moving device such that the nip roller is placed in one of the gripping state and the releasing state which is selected depending on a position of the conveyed recording medium.

13 Claims, 3 Drawing Sheets

IMAGE RECORDING APPARATUS

CROSS REFERENCE TO RELATED APPLICATION

This application claims priority from Japanese Patent Application No. 2008-188765 filed on Jul. 22, 2008, the disclosure of which is herein incorporated by reference in its entirety.

BACKGROUND OF THE INVENTION

1. Field of the Invention

The present invention relates to an image recording apparatus operable to record an image on a recording medium.

2. Discussion of Related Art

JP-2007-168277A discloses an inkjet recording apparatus including: a conveyor belt that is stretched around an upstream-side pulley and a downstream-side pulley; an inkjet head disposed to be opposed to the conveyor belt; an upstream-side nip roller cooperating with the upstream-side pulley to grip the conveyor belt therebetween; and a downstream-side nip roller cooperating with the downstream-side pulley to grip the conveyor belt therebetween (see FIG. 2 of JP-2007-168277A).

In the inkjet recording apparatus disclosed in JP-2007-168277A, a paper sheet as a supplied recording medium collides with the upstream-side nip roller just before being gripped between the upstream-side nip roller and conveyor belt. There is a case where the paper sheet is conveyed in a direction inclined with respect to a predetermined direction (in which the sheet is to be conveyed), due to its collision with the upstream-side nip roller. Further, a load acting on the conveyed paper sheet is changed, when the paper sheet passes through between the upstream-side nip roller and the conveyor belt, and when the paper sheet comes to be gripped between the downstream-side nip roller and the conveyor belt. Such a change could deteriorate quality of an image recorded on the paper sheet.

SUMMARY OF THE INVENTION

The present invention was made in view of the background prior art discussed above. It is therefore an object of the invention to provide an image recording apparatus capable of restraining deterioration of quality of the recorded image and/or restraining conveyance of the recording medium in an inclined direction, by selectively placing the nip roller in a gripping state and a releasing state.

This object may be achieved according to a principle of the invention, which provides an image recording apparatus including: (a) a conveying device having a supporting surface, and configured to convey a recording medium that is supported by the supporting surface, in a conveying direction; (b) a recording head disposed to be opposed to the supporting surface, and configured to record an image on the conveyed recording medium; (c) a nip roller disposed to be opposed to the supporting surface, and is movable to be brought into contact with the conveyed recording medium when the conveyed recording medium has a portion positioned in a contactable position in the conveying direction, namely, unless any portion of the sheet P is not positioned in the upstream-side contactable position; (d) a moving device configured to move the nip roller, so as to place the nip roller selectively in a gripping state and a releasing state, such that the nip roller, while being placed in the gripping state, is held in contact with the conveyed recording medium so as to cooperate with the supporting surface to grip the conveyed recording medium therebetween when the conveyed recording medium has a portion positioned in the contactable position, and such that the nip roller, while being placed in the releasing state, is not in contact with the conveyed recording medium even when the conveyed recording medium has a portion positioned in the contactable position; and (e) a controlling device configured to control the moving device such that the nip roller is placed in one of the gripping state and the releasing state which is selected depending on a position of the conveyed recording medium in the conveying direction.

In the present image recording apparatus, the nip roller is placed in one of the gripping state and the releasing state which is selected depending on the position of the conveyed recording medium, so that it is possible to avoid deterioration of quality of the image recorded on the conveyed recording medium and to avoid the recording medium from being conveyed in a direction inclined with respect to the conveying direction in which the recording medium is to be conveyed.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

Figure 1:
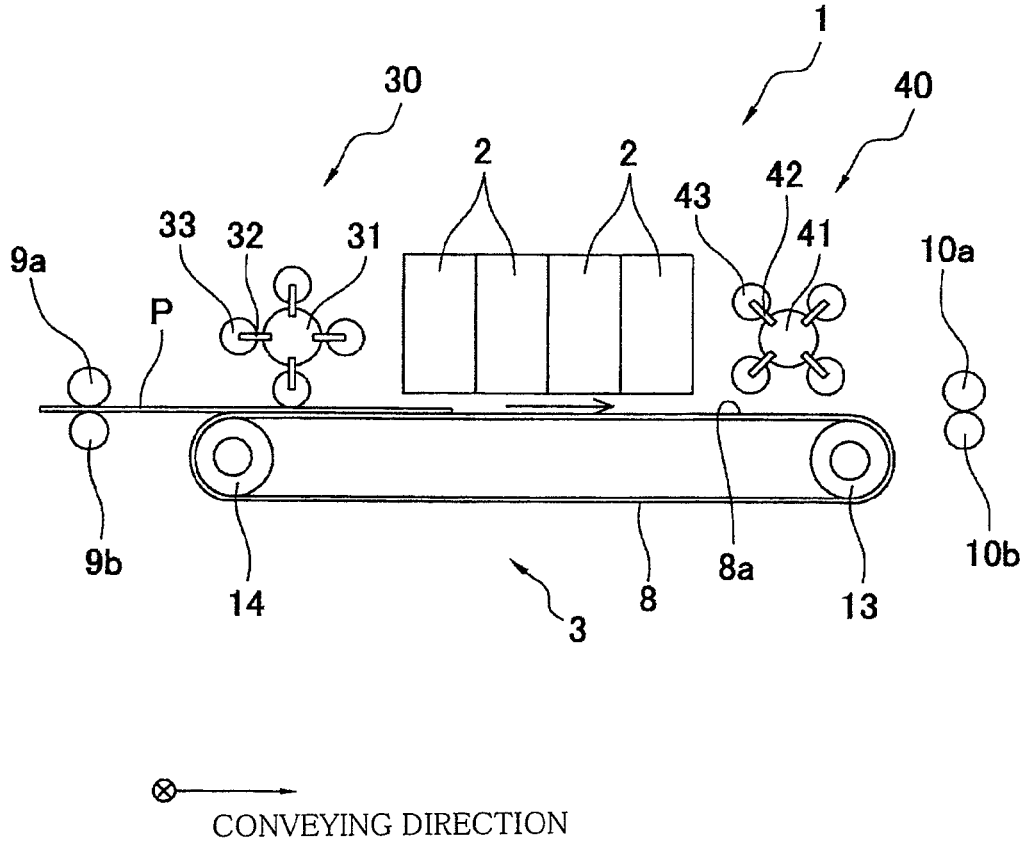
FIG. 1 is a view schematically showing an inkjet printer constructed according to an embodiment of the invention.

Referring to the drawings, there will be described an embodiment constructed according to the invention. This embodiment is an example in which the invention is applied to an inkjet printer operable to record an image (including literal character) on a recording medium by ejecting ink onto the recording medium.

Figure 2:
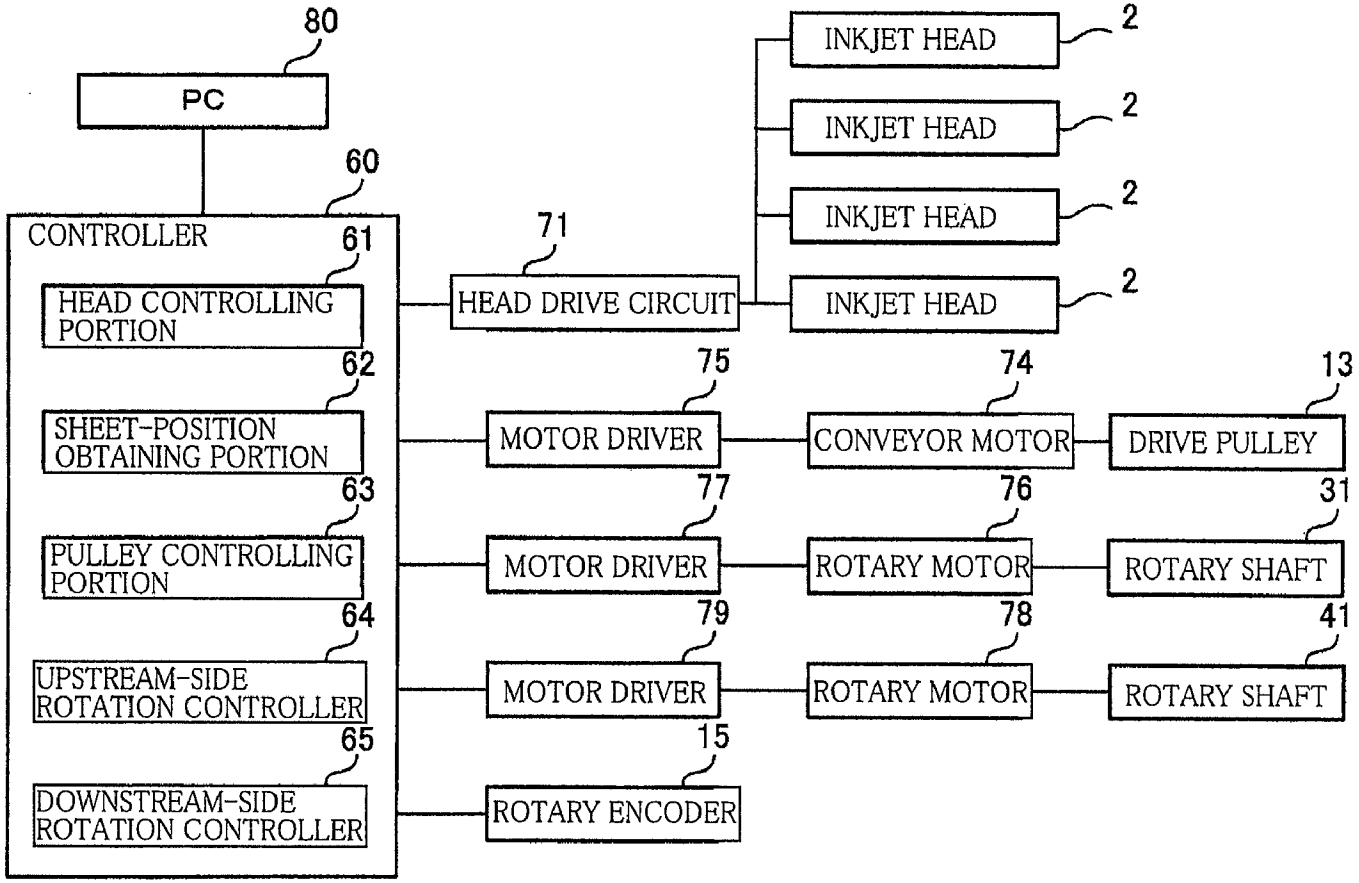
FIG. 2 is a block diagram showing a control arrangement in the inkjet printer of FIG. 1.

FIG. 1 shows an image recording apparatus in the form of a color inkjet printer 1 that is constructed according to the embodiment of the invention. As shown in FIG. 1, the inkjet printer 1 includes four inkjet heads 2 and a conveying device 3. The inkjet printer 1 further includes a controller 60 configured to control components of the printer 1, as shown in FIG. 2.

The four inkjet heads 2 are assigned to respective four ink colors (magenta, yellow, cyan, black) that are different from one another, and are arranged in a conveying direction (indicated by arrow in FIG. 1) in which a paper sheet P as a recording medium is to be conveyed by the conveying device 3. That is, the inkjet printer 1 is of line-type.

Each of the four inkjet heads 2 has a substantially rectangular parallelepiped body that is elongated in a width direction (i.e., a direction perpendicular to drawing sheet of FIG. 1) which is parallel to a supporting surface 8*a* of a conveyor belt 8 and which is perpendicular to the conveying direction. Further, each of the inkjet heads 2 has a bottom surface that is opposed to the supporting surface 8*a* of the conveyor belt 8, and is configured to eject ink droplets of a corresponding one of the ink colors while the paper sheet P supported on the supporting surface 8*a* is passing right below the inkjet head 2, so that the inkjet heads 2 cooperate with one another to perform a desired color image recording operation onto the sheet P.

The conveying device 3 includes a sheet supplier and a sheet discharger, and is configured to convey the sheet P in a direction away from the sheet supplier toward the sheet discharger. It is noted that the sheet supplier and the sheet discharger are located in a left portion and a right portion of FIG. 1, respectively, although not being shown in FIG. 1.

The conveying device 3 further includes a pair of register rollers 9*a*, 9*b* that are disposed in a position between the sheet supplier (not shown) and the upstream-side sheet gripper device 30 in the conveying direction. The register rollers 9*a*, 9*b* serve to correct inclined conveyance of the sheet P supplied from the sheet supplier, and to feed the sheet P toward the inkjet heads 2 by moving the sheet P in a rightward direction as seen in FIG. 1.

The conveying device 3 further includes a pair of conveying rollers 10*a*, 10*b* that are disposed in a position between a downstream-side sheet gripper device 40 and the sheet discharger (not shown) in the conveying direction. The conveying rollers 10*a*, 10*b* serve to convey the sheet P (supported on the supporting surface 8*a* of the conveyor belt 8) to the sheet discharger while gripping the sheet P therebetween, by moving the sheet P in the rightward direction as seen in FIG. 1.

The conveying device 3 further includes a pair of pulleys 13, 14 rotatable about their respective axes that are parallel to each other. The above-described conveyor belt 8, which is provided by an endless belt, is stretched around the pulleys 13, 14 so as to interconnect the pulleys 13, 14. When the pulleys 13, 14 are rotated, the supporting surface 8*a* is moved in the conveying direction so that the sheet P supported on the supporting surface 8*a* of the conveyor belt 8 is conveyed in the conveying direction. The supporting surface 8*a* is provided by an outer circumferential surface of the conveyor belt 8, and is parallel to bottom surfaces of the respective inkjet heads 2. The outer circumferential surface of the conveyor belt 8, which includes the supporting surface 8*a*, is coated with a silicon coating so as to have stickiness, so that the sheet P can be held on the supporting surface 8*a* with the stickiness.

A drive force is applied from a conveyor motor 74 (see FIG. 2) to a drive pulley 13 as one of the pair of pulleys 13, 14, so that the drive pulley 13 is rotated in a clockwise direction as seen in FIG. 1. A driven pulley 14 as the other of the pair of pulleys 13, 14 is rotated by a rotational force applied thereto from the drive pulley 13 via the conveyor belt 8, which runs in the conveying direction as a result of rotations of the pulleys 13, 14.

A rotary encoder 15 is provided on a rotary shaft of the drive pulley 13, so as to detect a rotational position of the drive pulley 13. A sheet position obtainer 62 is configured to obtain, based on the detected rotational position of the drive pulley 13, a position of the sheet P (conveyed and supported on the supporting surface 8*a*) in the conveying direction.

The upstream-side sheet gripper device 30 is disposed on a position which is located on a downstream side of the pair of register rollers 9*a*, 9*b* and on an upstream side of the plurality of inkjet heads 2 and which is opposed to the supporting surface 8*a* of the conveyor belt 8. The downstream-side sheet gripper device 40 is disposed on a position which is located on an upstream side of the pair of conveying rollers 10*a*, 10*b* and on a downstream side of the plurality of inkjet heads 2 and which is opposed to the supporting surface 8*a* of the conveyor belt 8.

The upstream-side sheet gripper device 30 includes a rotary shaft 31 as a rotary member, eight supporting members 32 extending radially outward from the rotary shaft 31, and four nip rollers 33. The rotary shaft 31 is disposed to be spaced apart from the supporting surface 8*a* by a predetermined distance, and is elongated in a width direction that is perpendicular to drawing sheet of FIG. 1. A drive force is applied from a rotary motor 76 (see FIG. 2) to the rotary shaft 31 whereby the rotary shaft 31 is rotated in a counterclockwise direction as seen in FIG. 1.

The eight supporting members 32 consist of four supporting members 32 provided on one of axially opposite end portions of the rotary shaft 31 and other four supporting members 32 provided on the other of the axially opposite end portions of the rotary shaft 31. The four supporting members 32 provided on the one of the axially opposite end portions of the rotary shaft 31 are arranged at a constant interval in a circumferential direction of the rotary shaft 31, and the other four supporting members 32 provided on the other of the axially opposite end portions are also arranged at a constant interval in the circumferential direction of the rotary shaft 31. Each of the four nip rollers 33 is a driven roller rotatably supported at its axis by corresponding two of the supporting members 32 that overlap with each other in an axial direction of the nip rollers 33, so that the four nip rollers 33 are arranged at a constant interval in the circumferential direction of the rotary shaft 31.

Each of the four nip rollers 33 is brought into contact with the sheet P, when being positioned right below the rotary shaft 31, namely, positioned in an upstream-side contactable position which is aligned with the rotary shaft 31 in the conveying direction and which is located on one of vertically opposite sides of the rotary shaft 31 that is close to the conveyor belt 8. That is, each of the nip rollers 33, when being positioned in the upstream-side contactable position, is brought into contact with a portion of the sheet P which is positioned in the upstream-side contactable position in the conveying direction. In other words, the nip roller 33 positioned in the upstream-side contactable position is brought into contact with the sheet P supported on the supporting surface 8*a*, when the sheet P has a portion positioned in the upstream-side contactable position, namely, unless any portion of the sheet P is not positioned in the upstream-side contactable position. When the nip roller 33 is held in contact with the sheet P, namely, when the nip roller 33 is placed in a gripping state, the nip roller 33 cooperates with the supporting surface 8*a* to grip the sheet P therebetween, and is rotated by the conveyed sheet P. It is noted that, each nip roller 33 is not brought into contact with the sheet P, namely, each nip roller 33 is placed in a releasing state, while not being positioned in the upstream-side contactable position even when the sheet P has a portion positioned in the upstream-side contactable position. The nip roller 33 does not grip the sheet P while being placed in the releasing state.

The rotary shaft 31 is rotated about its axis (that is parallel to the supporting surface 8*a* and is perpendicular to the conveying direction) under control of an upstream-side rotation controller 64, whereby each nip roller 33 is revolved about the axis of the rotary shaft 31, so as to be placed selectively in the gripping state and the releasing state. When each nip roller 33 is to be placed from the releasing state to the gripping state, the rotary shaft 31 is rotated in a counterclockwise direction as seen in FIG. 1, so that the nip roller 33 is moved in a direction inclined with respect to the sheet P so as to be brought into contact with the sheet P.

The downstream-side sheet gripper device 40 includes a rotary shaft 41 as a rotary member, eight supporting members 42 extending radially outward from the rotary shaft 41, and four nip rollers 43. The rotary shaft 41 is disposed to be spaced apart from the supporting surface 8*a* by a predetermined distance, and is elongated in the width direction that is perpendicular to drawing sheet of FIG. 1. The rotary shaft 41, eight supporting members 42 and four nip rollers 43 of the downstream-side sheet gripper device 40 are substantially identical in construction with the above-described rotary shaft 31, eight supporting members 32 and four nip rollers 33 of the upstream-side sheet gripper device 30. A drive force is applied from a rotary motor 78 (see FIG. 2) to the rotary shaft 41 whereby the rotary shaft 41 is rotated in a counterclockwise direction as seen in FIG. 1. Each of the four nip rollers 43 is brought into contact with the sheet P, when being positioned right below the rotary shaft 41, namely, positioned in a downstream-side contactable position which is aligned with the rotary shaft 41 in the conveying direction and which is located on one of vertically opposite sides of the rotary shaft 41 that is close to the conveyor belt 8. That is, each of the nip rollers 43, when being positioned in the downstream-side contactable position, is brought into contact with a portion of the sheet P which is positioned in the downstream-side contactable position in the conveying direction. In other words, the nip roller 43 positioned in the downstream-side contactable position is brought into contact with the sheet P supported on the supporting surface 8*a*, when the sheet P has a portion positioned in the downstream-side contactable position, namely, unless any portion of the sheet P is not positioned in the downstream-side contactable position. When the nip roller 43 is held in contact with the sheet P, namely, when the nip roller 43 is placed in a gripping state, the nip roller 43 cooperates with the supporting surface 8*a* to grip the sheet P therebetween, and is rotated by the conveyed sheet P. It is noted that, each nip roller 43 is not brought into contact with the sheet P, namely, each nip roller 43 is placed in a releasing state, while not being positioned in the downstream-side contactable position even when the sheet P has a portion positioned in the downstream-side contactable position. The nip roller 43 does not grip the sheet P while being placed in the releasing state. The rotary shaft 41 is rotated about its axis under control of a downstream-side rotation controller 65, whereby each nip roller 43 is revolved about the axis of the rotary shaft 41, so as to be placed selectively in the gripping state and the releasing state.

In each of the upstream-side sheet gripper device 30 and downstream-side sheet gripper device 40, each of the nip rollers 33, 43 is moved in a direction that includes a component parallel to a vertical direction (i.e., a downward direction as seen in FIG. 1) and a component parallel to the conveying direction, so that it is possible to reduce a load applied from each of the nip rollers 33, 43 to the sheet P when the nip roller is brought into contact with the sheet P. The reduction of the applied load leads to reduction of influence affecting on an image recorded on the sheet P. Further, upon contact of each of the nip rollers 33, 43 with the sheet P, a velocity of movement of the nip roller as measured in the conveying direction is substantially equal to a velocity at which the sheet P is conveyed, so that it is possible to further reduce the applied load and accordingly to further reduce the influence affecting on the recorded image. Since each of the nip rollers 33, 43 is attached to a corresponding one of the rotary shafts 31, 41 (that are rotatable about their respective axes parallel to the width direction) so as to be revolved about the axis of the corresponding rotary shaft, it is easy to arrange such that the component parallel to the conveying direction is included in the direction of the movement of the nip roller.

Further, upon placement of each of the nip rollers 33, 43 from its releasing state to its gripping state, the velocity of movement of the nip roller as measured in the conveying direction is substantially equal to a running velocity of the conveyor belt 8, i.e., the conveying velocity of the sheet P. Owing to this arrangement, it is possible to further reduce the load applied from each of the nip rollers 33, 43 to the sheet P when the nip roller is brought into contact with the sheet P, and accordingly to further reduce the influence affecting on the recorded image. In the present embodiment, the rotary shaft 31, supporting members 32, up seam-side rotation controller 64, rotary shaft 41, supporting members 42 and downstream-side rotation controller 65 cooperate with one another to constitute a moving device.

Referring next to FIG. 2, there will be described a control arrangement in the inkjet printer 1. The controller 60 of the inkjet printer 1 is principally constituted by CPU (Central Processing Unit), ROM (Read Only Memory) storing various control programs executed by the CPU and various data used in execution of the control programs, and RAM (Random Access Memory) for temporarily storing various data in execution of the control programs.

As shown in FIG. 2 that is a block diagram of the control arrangement of the printer 1, the controller 60 includes a head controlling portion 61, a sheet-position obtaining portion 62 and an pulley controlling portion 63, in addition to the above-described upstream-side rotation controller 64 and downstream-side rotation controller 65.

The head controlling portion 61 is configured to control a head drive circuit 71, when the controller 60 receives print command signals supplied from PC (personal computer) 80, such that ink droplets are ejected from a selected one or ones of the inkjet heads 2.

The sheet-position obtaining portion 62 is configured to obtain a position of the sheet P (supported on the supporting surface 8*a*) in the conveying direction, based on an angular position of the drive pulley 13 which is detected by the rotary encoder 15. For example, the angular position of the drive pulley 13 is detected as a value relative to a value at a point of time at which the sheet P is supplied from the sheet supplier (not shown), and the position of the sheet P in the conveying direction can be obtained from an amount of rotation of the drive pulley 13 which is calculated from the detected angular position. The encoder 15 and the sheet-position obtaining portion 62 cooperate with each other to constitute a position detecting device.

The pulley controlling portion 63 is configured to control a motor driver 75 such that the conveyor motor 74 is driven to rotate the drive pulley 13 for running the conveyor belt 8, for thereby conveying the sheet P supported on the supporting surface 8*a*.

The upstream-side rotation controller 64 is configured to control a motor driver 77 such that all of the nip rollers 33 are held in their releasing states until it is confirmed by the sheet-position obtaining portion 62 that a leading end of the sheet P (supported on the supporting surface 8*a*) reaches the above-described upstream-side contactable position. In this instance, each of the nip rollers 33 is placed in its releasing sate, by driving the rotary motor 76 in a manner causing the rotary shaft 31 to be rotated in the counterclockwise direction (as seen in FIG. 1) such that each nip roller 33 is positioned in a position that is other than the upstream-side contactable position.

Further, the upstream-side rotation controller 64 is configured to control the motor driver 77 such that the rotary motor 76 is driven in a manner causing the rotary shaft 31 to be rotated in the counterclockwise direction (as seen in FIG. 1), after it has been confirmed by the sheet-position obtaining portion 62 that the leading end of the sheet P had reached the upstream-side contactable position, before a recording operation starts to be performed onto the sheet P (namely, before it is confirmed that the leading end of the sheet P reaches an upstream end portion of an upstream end one of the inkjet heads 2 in the conveying direction). In this instance, the motor driver 77 is controlled by the upstream-side rotation controller 64 such that one of the nip rollers 33, which is located to be closer than the other nip rollers 33 to the upstream-side contactable position in the counterclockwise direction, is moved to the upstream-side contactable position so as to be brought into contact with the sheet P that is held on the supporting surface 8*a*. Thus, the one of the nip rollers 33 is placed from its releasing state to its gripping state.

Further, the upstream-side rotation controller 64 is configured to control the motor driver 77 such that the rotary motor 76 is driven in a manner causing the rotary shaft 31 to be rotated in the counterclockwise direction (as seen in FIG. 1), after it has been confirmed by the sheet-position obtaining portion 62 that a trailing end of the sheet P had passed through between the register rollers 9*a*, 9*b*, before it is confirmed that the trailing end of the sheet P reaches the upstream-side contactable position. In this instance, the motor driver 77 is controlled by the upstream-side rotation controller 64 such that the above-described one of the nip rollers 33 is moved away from the upstream-side contactable position. Thus, the one of the nip rollers 33 is placed from its gripping state to its releasing state.

Meanwhile, the downstream-side rotation controller 65 is configured to control a motor driver 79 such that all of the nip rollers 43 are held in their releasing states until it is confirmed by the sheet-position obtaining portion 62 that the leading end of the sheet P (supported on the supporting surface 8*a*) reaches the above-described downstream-side contactable position. In this instance, each of the nip rollers 43 is placed in its releasing sate, by driving the rotary motor 78 in a manner causing the rotary shaft 41 to be rotated in the counterclockwise direction (as seen in FIG. 1) such that each nip roller 43 is positioned in a position that is other than the upstream-side contactable position.

Further, the downstream-side rotation controller 65 is configured to control the motor driver 79 such that the rotary motor 78 is driven in a manner causing the rotary shaft 41 to be rotated in the counterclockwise direction (as seen in FIG. 1), after it has been confirmed by the sheet-position obtaining portion 62 that the leading end of the sheet P reached the downstream-side contactable position. In this instance, the motor driver 79 is controlled by the downstream-side rotation controller 65 such that one of the nip rollers 43, which is located to be closer than the other nip rollers 43 to the downstream-side contactable position in the counterclockwise direction, is moved to the downstream-side contactable position so as to be brought into contact with the sheet P that is held on the supporting surface 8*a*. Thus, the one of the nip rollers 43 is placed from its releasing state to its gripping state.

Further, the downstream-side rotation controller 65 is configured to control the motor driver 79 such that the rotary motor 78 is driven in a manner causing the rotary shaft 41 to be rotated in the counterclockwise direction (as seen in FIG. 1), after the recording operation performed onto the sheet P has been completed (namely, after it has been confirmed that the trailing end of the sheet P reached a downstream end portion of a downstream end one of the inkjet heads 2 in the conveying direction). In this instance, the motor driver 79 is controlled by the downstream-side rotation controller 65 such that the above-described one of the nip rollers 43 is moved away from the downstream-side contactable position. Thus, the one of the nip rollers 43 is placed from its gripping state to its releasing state.

Figure 3:
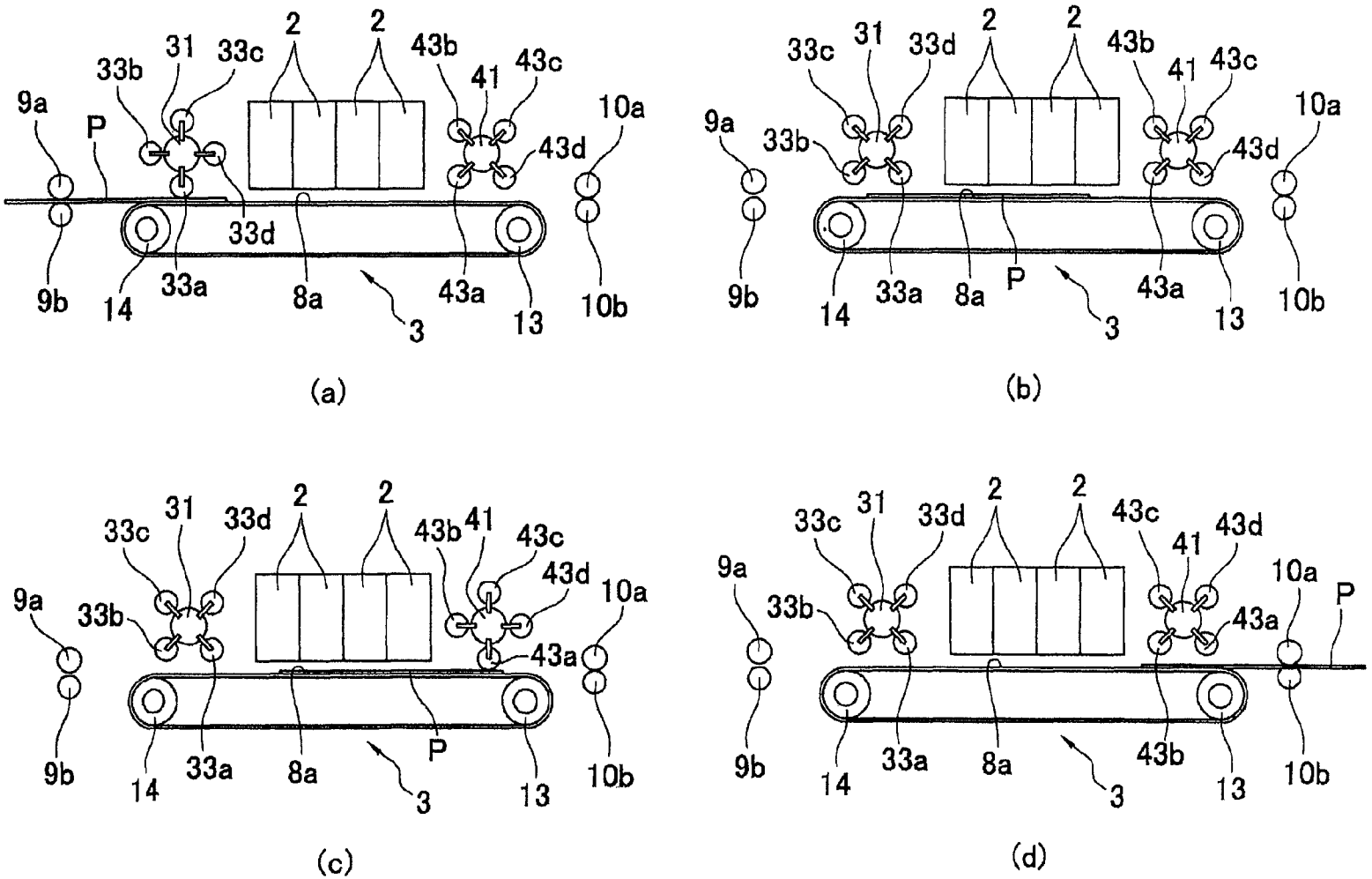
FIG. 3 is a set of views showing gripping operations of nip rollers in the inkjet printer of FIG. 1, wherein view (a) shows a stage in which an upstream-side nip roller is placed from a releasing state to a gripping state, view (b) shows a stage in which the upstream-side nip roller is placed from the gripping state to the releasing state, view (c) shows a stage in which a downstream-side nip roller is placed from the releasing state to the gripping state, and view (d) shows a stage in the downstream-side nip roller is placed from the gripping state to the releasing state.

Referring next to FIG. 3, there will be described gripping operations of the nip rollers 33, 43 in process of conveyance of the sheet P from the sheet supplier (not shown) to the sheet discharger (not shown). FIG. 3 is a set of views showing the gripping operations of the nip rollers 33, 43, wherein view (a) shows a stage in which one of the nip rollers 33 of the upstream-side gripper device 30 is placed from its releasing state to its gripping state, view (b) shows a stage in which the one of the nip rollers 33 is placed from its gripping state to its releasing state, view (c) shows a stage in which one of the nip rollers 43 of the downstream-side gripper device 40 is placed from its releasing state to its gripping state, and view (d) shows a stage in which the one of the nip rollers 43 is placed from its gripping state to its releasing state. In FIG. 3, the four rollers 33 of the upstream-side gripper device 30 are denoted by respective reference signs 33*a*, 33*b*, 33*c*, 33*d* as viewed in a clockwise direction about the rotary shaft 31, while the four rollers 43 of the downstream-side gripper device 40 are denoted by respective reference signs 43*a*, 43*b*, 43*c*, 43*d* as viewed in a clockwise direction about the rotary shaft 41.

When the controller 60 receives the print command signals supplied from the PC 80, the sheet P is supplied from the sheet supplier (not shown). The supplied sheet P is conveyed to the supporting surface 8*a* while its inclination is being corrected by the register rollers 9*a*, 9*b*. In this instance, any one of the nip rollers 33*a*, 33*b*, 33*c*, 33*d* of the upstream-side gripper device 30 is not placed in the upstream-side contactable position, so that all of the nip rollers 33*a*, 33*b*, 33*c*, 33*d* are held in the respective releasing states. Meanwhile, similarly, any one of the nip rollers 43*a*, 43*b*, 43*c*, 43*d* of the downstream-side gripper device 40 is not placed in the downstream-side contactable position, so that all of the nip rollers 43*a*, 43*b*, 43*c*, 43*d* are held in the respective releasing states.

The sheet P, whose inclination has been corrected by the register rollers 9*a*, 9*b*, is conveyed while being supported on the supporting surface 8*a*. As shown in view (a) of FIG. 3, the rotary shaft 31 is controlled by the upstream-side rotation controller 64 so as to be rotated in the counterclockwise direction, after it has been confirmed by the sheet-position obtaining portion 62 that the leading end of the sheet P had reached the upstream-side contactable position, before a recording operation starts to be performed onto the sheet P. By the rotation of the rotary shaft 31 in the counterclockwise direction, the nip roller 33*a*, which is located to be closer than the other nip rollers 33*b*, 33*c*, 33*d* to the upstream-side contactable position in the counterclockwise direction, is moved to the upstream-side contactable position so as to be brought into contact with the sheet P. When the nip roller 33*a* has been thus placed from its releasing state to its gripping state, the rotary shaft 31 is controlled by the upstream-side rotation controller 64 so as to be stopped.

Then, the sheet P supported on the supporting surface 8*a* is conveyed while being gripped between the nip roller 33*a* and the supporting surface 8*a*. Thus, the sheet P reaches the upstream-side contactable position without its leading end colliding with the nip roller 33*a*, since the nip roller 33*a* is still in its releasing state when the sheet P reaches the upstream-side contactable position, so that it is possible to prevent the sheet P from being inclined with respect to the conveying direction. Further, since the sheet P comes to be gripped between the nip roller 33*a* and the supporting surface 8*a*, before the recording operation starts to be performed onto the sheet P, it is possible to restrain an image recorded on the sheet P, from being influenced by a load applied to the conveyed sheet P from a conveyance guide and the register rollers 9*a*, 9*b* that are disposed on an upstream side of the nip roller 33*a* in the conveying direction.

Then, as shown in view (b) of FIG. 3, the rotary shaft 31 is controlled by the upstream-side rotation controller 64 so as to be rotated again in the counterclockwise direction, after it has been confirmed by the sheet-position obtaining portion 62 that the trailing end of the sheet P had passed through between the registers 9*a*, 9*b*, before it is confirmed by the sheet-position obtaining portion 62 that the trailing end of the sheet P reaches the upstream-side contactable position. By the rotation of the rotary shaft 31 in the counterclockwise direction, the nip roller 33*a* moved away from the upstream-side contactable position. When the nip roller 33*a* has been thus placed from its gripping state to its releasing state, the rotary shaft 31 is controlled by the upstream-side rotation controller 64 so as to be stopped. It is therefore possible to prevent from deteriorating quality of an image recorded on the sheet P, since the nip roller 33*a* is already placed in the releasing state when the trailing end of the sheet P reaches the contactable position. Further, it is possible to restrain the recorded image from being influenced by a load applied to the conveyed sheet P from the register rollers 9*a*, 9*b* that are disposed on the upstream side of the nip roller 33*a*.

Then, as shown in view (c) of FIG. 3, the rotary shaft 41 is controlled by the downstream-side rotation controller 65 so as to be rotated in the counterclockwise direction, after it has been confirmed by the sheet-position obtaining portion 62 that the leading end of the sheet P had reached the downstream-side contactable position. By the rotation of the rotary shaft 41 in the counterclockwise direction, the nip roller 43*a*, which is located to be closer than the other nip rollers 43*b*, 43*c*, 43*d* to the downstream-side contactable position in the counterclockwise direction, is moved to the downstream-side contactable position so as to be brought into contact with the sheet P. When the nip roller 43*a* has been thus placed from its releasing state to its gripping state, the rotary shaft 41 is controlled by the downstream-side rotation controller 65 so as to be stopped. Thus, the sheet P reaches the downstream-side contactable position without its leading end colliding with the nip roller 43*a*, since the nip roller 43*a* is still in its releasing state when the sheet P reaches the downstream-side contactable position, so that it is possible to restrain reduction of quality of the image recoded on the sheet P.

Then, as shown in view (d) of FIG. 3, the rotary shaft 41 is controlled by the downstream-side rotation controller 65 so as to be rotated again in the counterclockwise direction, after the recording operation performed on the sheet P (conveyed while being gripped between the nip roller 43*a* and the supporting surface 8*a*) has been completed. By the rotation of the rotary shaft 41 in the counterclockwise direction, the nip roller 43*a* moved away from the downstream-side contactable position. When the nip roller 43*a* has been thus placed from its gripping state to its releasing state, the rotary shaft 41 is controlled by the downstream-side rotation controller 65 so as to be stopped. Owing to this arrangement, it is possible to restrain the image recorded on the sheet P, from being influenced by a load applied to the conveyed sheet P from the conveyance guide and the conveying rollers 10*a*, 10*b* that are disposed on a downstream side of the nip roller 43*a* in the conveying direction.

When the subsequent sheet P is supplied to the supporting surface 8*a* of the conveyor belt 8, each of the nip rollers 33*b*, 43*b* is placed in its gripping state and releasing state in the same manner as each of the nip rollers 33*a*, 43*a* was. That is, four sheets P are subjected to the recording operation during one rotation of each of the rotary shafts 31, 41. Thus, since a plurality of nip rollers (four nip rollers in the present embodiment) are arranged in a circumferential direction of each of the rotary shafts 31, 41, each of the upstream-side gripper device 30 and downstream-side gripper device 40 is capable of reliably gripping the sheet P even where the sheet P is conveyed by the conveying device 3 at a high velocity.

In the inkjet printer 1 as described above, each of the nip rollers 33, 43 is placed in one of the gripping state and releasing state which is selected depending on the position of the conveyed sheet P, so that it is possible to restrain deterioration of quality of the recorded image and/or restrain conveyance of the sheet P in an inclined direction.

While the preferred embodiment of the invention has been described, it is to be understood that the invention is not limited to the details of the illustrated embodiment, but may be embodied with various other changes, modifications and improvements.

In the above-described embodiment, the upstream-side gripper device 30 and downstream-side gripper device 40 are provided on the respective upstream and downstream sides of the plurality of inkjet heads 2 in the conveying direction. However, the provisions of the upstream-side gripper device 30 and downstream-side gripper device 40 are not essential, and one of the upstream-side gripper device 30 and downstream-side gripper device 40 may be omitted.

Further, the number of the nip rollers provided on each of the rotary shafts 31, 41 does not necessarily have to be four, and may be smaller or larger than four.

Further, in the above-described embodiment, each nip roller is switched between the gripping and releasing states, by revolving the nip roller about an axis of the corresponding rotary shaft. However, each nip roller may be switched between the gripping and releasing state, for example, by moving the nip roller in the vertical direction.

Further, the image recording apparatus according to the invention does not necessary have to be an inkjet printer, and may be a thermal printer or even a non-printer machine such as facsimile and copying machines.

What is claimed is:

1. An image recording apparatus comprising:

a conveying device having a supporting surface, and configured to convey a recording medium that is supported by said supporting surface, in a conveying direction;

a recording head disposed to be opposed to said supporting surface, and configured to record an image on the conveyed recording medium;

a nip roller disposed to be opposed to said supporting surface, and is movable to be brought into contact with the conveyed recording medium when the conveyed recording medium has a portion positioned in a contactable position in said conveying direction;

a moving device configured to move said nip roller, so as to place said nip roller selectively in a gripping state and a releasing state, such that said nip roller, while being placed in said gripping state, is held in contact with the conveyed recording medium so as to cooperate with said supporting surface to grip the conveyed recording medium therebetween when the conveyed recording medium has a portion positioned in said contactable position, and such that said nip roller, while being placed in said releasing state, is not in contact with the conveyed recording medium even when the conveyed recording medium has a portion positioned in said contactable position; and a controlling device configured to control said moving device such that said nip roller is placed in one of said gripping state and said releasing state which is selected depending on a position of the conveyed recording medium in said conveying direction, wherein said nip roller is moved in a direction that includes a component parallel to said conveying direction, when said nip roller is placed by said moving device from said releasing state to said gripping state.

2. The image recording apparatus according to claim 1, further comprising a position detecting device configured to detect the position of the conveyed recording medium in said conveying direction, wherein said controlling device is configured to control said moving device such that said nip roller is placed in one of said gripping state and said releasing state which is selected depending on the position of the conveyed recording medium detected by said position detecting device.

3. The image recording apparatus according to claim 1, wherein said nip roller is disposed in a downstream side of the recording head in said conveying direction, and wherein said controlling device is configured to control said moving device, such that said nip roller is placed in said releasing state until a leading end portion of the conveyed recording medium reaches said contactable position, and such that said nip roller is placed from said releasing state to said gripping state after the leading end portion of the conveyed recording medium reaches said contactable position.

4. The image recording apparatus according to claim 3, wherein said controlling device is configured to control said moving device such that said nip roller is placed from said gripping state to said releasing state after the image is recorded on the conveyed recording medium.

5. The image recording apparatus according to claim 1, wherein said nip roller is disposed in an upstream side of the recording head in said conveying direction, and wherein said controlling device is configured to control said moving device such that said nip roller is placed from said gripping state to said releasing state before a trailing end portion of the conveyed recording medium reaches said contactable position.

6. The image recording apparatus according to claim 5, further comprising a pair of rollers which is disposed in an upstream side of said nip roller in said conveying direction and which is configured to cooperate with each other to grip the conveyed recording medium therebetween, wherein said controlling device is configured to control said moving device such that said nip roller is placed from said gripping state to said releasing state after the trailing end portion of the conveyed recording medium is released from said pair of rollers.

7. The image recording apparatus according to claim 1, wherein said nip roller is disposed in an upstream side of the recording head in said conveying direction, and wherein said controlling device is configured to control said moving device, such that said nip roller is placed in said releasing state until a leading end portion of the recording medium reaches said contactable position, and such that said nip roller is placed from said releasing state to said gripping state after the leading end portion of the conveyed recording medium reaches said contactable position.

8. The image recording apparatus according to claim 7, wherein said controlling device is configured to control said moving device such that said nip roller is placed from said releasing state to said gripping state before the image is recorded on the conveyed recording medium.

9. The image recording apparatus according to claim 1, wherein a velocity of movement of said nip roller as measured in said conveying direction is substantially equal to a velocity at which the conveyed recording medium is conveyed by said conveying device.

10. The image recording apparatus according to claim 1, further comprising a rotary member rotatable about an axis which is parallel to said supporting surface of said conveying device and which is perpendicular to said conveying direction, wherein said nip roller is attached to said rotary member, so as to be revolved about said axis when said rotary member is rotated.

11. The image recording apparatus according to claim 10, comprising a plurality of nip rollers each of which is said nip roller, wherein said plurality of nip rollers are attached to said rotary member such that said nip rollers are arranged in a circumferential direction of said rotary member.

12. The image recording apparatus according to claim 1, further comprising a rotary member rotatable about an axis which is parallel to said supporting surface of said conveying device and which is perpendicular to said conveying direction, wherein said nip roller is attached to said rotary member, so as to be revolved about said axis when said rotary member is rotated.

13. An image recording apparatus comprising:

a conveying device having a supporting surface, and configured to convey a recording medium that is supported by said supporting surface, in a conveying direction;

a recording head disposed to be opposed to said supporting surface, and configured to record an image on the conveyed recording medium;

a nip roller disposed to be opposed to said supporting surface, and is movable to be brought into contact with the conveyed recording medium when the conveyed recording medium has a portion positioned in a contactable position in said conveying direction;

a moving device configured to move said nip roller, so as to place said nip roller selectively in a gripping state and a releasing state, such that said nip roller, while being placed in said gripping state, is held in contact with the conveyed recording medium so as to cooperate with said supporting surface to grip the conveyed recording medium therebetween when the conveyed recording medium has a portion positioned in said contactable position, and such that said nip roller, while being placed in said releasing state, is not in contact with the conveyed recording medium even when the conveyed recording medium has a portion positioned in said contactable position;

a controlling device configured to control said moving device such that said nip roller is placed in one of said gripping state and said releasing state which is selected depending on a position of the conveyed recording medium in said conveying direction; and a rotary member rotatable about an axis which is parallel to said supporting surface of said conveying device and which is perpendicular to said conveying direction, wherein said nip roller is attached to said rotary member, so as to be revolved about said axis when said rotary member is rotated, wherein said image recording apparatus further comprises a plurality of nip rollers each of which is said nip roller, and wherein said plurality of nip rollers are attached to said rotary member such that said nip rollers are arranged in a circumferential direction of said rotary member.

* * * * *